US008965257B2

(12) United States Patent
Nakura et al.

(10) Patent No.: US 8,965,257 B2
(45) Date of Patent: Feb. 24, 2015

(54) IMAGE FORMING APPARATUS

(71) Applicants: Makoto Nakura, Ibaraki (JP); Shinya Tomita, Ibaraki (JP); Naoto Ueda, Ibaraki (JP); Yoshinari Onuma, Ibaraki (JP); Masanori Takayasu, Ibaraki (JP)

(72) Inventors: Makoto Nakura, Ibaraki (JP); Shinya Tomita, Ibaraki (JP); Naoto Ueda, Ibaraki (JP); Yoshinari Onuma, Ibaraki (JP); Masanori Takayasu, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/081,109

(22) Filed: Nov. 15, 2013

(65) Prior Publication Data

US 2014/0140741 A1 May 22, 2014

(30) Foreign Application Priority Data

Nov. 22, 2012 (JP) ..... 2012-256051

(51) Int. Cl.
*G03G 15/01* (2006.01)
*G03G 15/16* (2006.01)

(52) U.S. Cl.
CPC ..... *G03G 15/1615* (2013.01); *G03G 15/0136* (2013.01); *G03G 2215/0129* (2013.01)
USPC ..... 399/302

(58) Field of Classification Search
USPC ..... 399/297, 302, 308
See application file for complete search history.

(56) References Cited

U.S. PATENT DOCUMENTS 5,963,769 A * 10/1999 Emukai et al. ..... 399/297
6,853,825 B2 * 2/2005 Suzuki et al. ..... 399/167
7,844,207 B2 11/2010 Ryo et al.
8,014,701 B2 9/2011 Nakura et al.
8,023,872 B2 9/2011 Tao et al.
8,059,999 B2 * 11/2011 Inoue et al. ..... 399/302
8,086,156 B2 12/2011 Tao et al.
8,095,056 B2 1/2012 Mikajiri et al.
8,160,482 B2 4/2012 Nakura
8,238,793 B2 8/2012 Nakura et al.
8,391,759 B2 3/2013 Nakura
8,515,310 B2 8/2013 Nakura et al.
2012/0257915 A1 10/2012 Nakura et al.
2012/0263497 A1 10/2012 Nakura et al.
2013/0049287 A1 2/2013 Ueda et al.
2013/0049296 A1 2/2013 Takai et al.
2013/0189003 A1 * 7/2013 Yu et al. ..... 399/313
2013/0195482 A1 8/2013 Nakura et al.
2013/0223902 A1 * 8/2013 Oishi et al. ..... 399/313
2013/0228969 A1 9/2013 Nakura et al.
2013/0251434 A1 * 9/2013 Ueda et al. ..... 399/388
2014/0042689 A1 * 2/2014 Ota et al. ..... 271/10.11
2014/0140741 A1 * 5/2014 Nakura et al. ..... 399/297

FOREIGN PATENT DOCUMENTS

JP 11-052757 2/1999

* cited by examiner

*Primary Examiner* — W B Perkey
(74) *Attorney, Agent, or Firm* — Oblon, Spivak, McClelland, Maier & Neustadt, L.L.P.

(57) ABSTRACT

An image forming apparatus includes an image carrier, a transfer unit to transfer the image onto a recording medium, a torque limit unit to transmit drive force to the transfer unit at a torque less than the torque for transmitting drive force, and drive the transfer unit to rotate at a circumferential velocity higher than that of the image carrier when the image carrier and the transfer unit are in contact with each other, and a drive unit to output drive force to drive the transfer unit such that the transfer unit rotates at a circumferential velocity lower than that of the image carrier when the image carrier and the transfer unit are separate from each other, and the transfer unit rotates at a circumferential velocity higher than that of the image carrier when the image carrier and the transfer unit are in contact with each other.

6 Claims, 4 Drawing Sheets

IMAGE FORMING APPARATUS

BACKGROUND OF THE INVENTION

1. Field of the Invention

The disclosures discussed herein relate to an image forming apparatus.

2. Description of the Related Art

There is provided a commercially available image forming apparatus having a configuration in which toner images formed on a photoconductor are transferred onto an intermediate transfer belt, the toner images formed on the intermediate transfer belt are secondarily transferred and printed onto a sheet of paper while passing through an interval between the intermediate transfer belt and a transfer roller coming into contact with the intermediate transfer belt.

In such an image forming apparatus, the difference or fluctuation may occur between the circumferential velocity of the rotating intermediate transfer belt and the sheet transporting velocity during the toner images formed on the intermediate transfer belt being secondarily transferred onto the sheet. This may result in degradation of image qualities as well as misalignment of toner images, in a case of duplex printing, on two surfaces of the sheet due to deviation of the positions at which the toner image on the intermediate transfer belt are transferred onto the sheet, deviation of the image positions, non-uniform density, and the like.

Japanese Laid-open Patent Publication No. 11-52757, for example, discloses a configuration to eliminate the above drawbacks. In the disclosed configuration, a torque limiter configured to transmit drive force at a torque less than that obtained when the transfer roller being in contact with an intermediate transfer belt is disposed in a drive mechanism between a drive unit configured to drive a transfer roller and the transfer roller. In this configuration, the transfer roller is brought into contact with the intermediate transfer belt at the velocity faster than the velocity of the intermediate transfer belt, which causes the torque limiter to slip. As a result, the intermediate transfer belt is driven to rotate with constant velocity in accordance with the traveling (rotations) of the intermediate transfer belt.

With such a configuration, since the transfer roller is driven by following the traveling (rotations) of the intermediate transfer belt, the circumferential velocity of the intermediate transfer belt and the sheet transporting velocity are maintained at a constant velocity, which prevents degradation of the image quality due to deviation in positions of the transferred images.

However, in the image forming apparatus having a contact/separate mechanism between the intermediate transfer belt and the transfer roller, the toner images on the intermediate transfer belt may be misaligned or disarrayed, due to impact applied to the intermediate transfer belt when the transfer roller and the intermediate transfer belt come into contact with each other or are separate from each other. Further, the velocity of the intermediate transfer belt fluctuates while the transfer roller is separate from the intermediate transfer belt, which may degrade the image quality due to deviation in the positions of the toner images transferred from the photoconductor. Specifically, when the transfer roller is brought into contact with the intermediate transfer belt at the velocity faster than that of the intermediate transfer belt, the impact applied from the transfer roller to the intermediate transfer belt is enormous and hence, the degradation of image quality may become significant.

RELATED ART DOCUMENTS

Patent Document

Patent Document 1: Japanese Laid-open Patent Publication No. 11-52757

SUMMARY OF THE INVENTION

Accordingly, it is a general object in one embodiment of the present invention to provide an image forming apparatus capable of reducing impact applied when an image carrier and a transfer unit are brought into contact with each other and are separate from each other, and capable of preventing image degradation due to fluctuation occurring in a circumferential velocity of the image carrier or a transporting velocity of the recording medium.

According to one aspect of the embodiment, there is provided an image forming apparatus that includes an image carrier configured to carry an image while being rotationally driven; a transfer unit rotationally disposed with respect to the image carrier and capable of being brought into contact with or separate from the image carrier, the transfer unit being configured to transfer the image onto a recording medium transported by being sandwiched between the transfer unit and the image carrier; a torque limit unit disposed on a drive mechanism configured to transmit drive force to rotate the transfer unit, and configured to transmit drive force to the transfer unit at a torque less than a torque for transmitting drive force, the drive force transmitted to the transfer unit driving the transfer unit to rotate at a circumferential velocity higher than a circumferential velocity of the image carrier in a state where the image carrier and the transfer unit are in contact with each other; and a drive unit configured to output drive force to drive the transfer unit such that the transfer unit rotates at a circumferential velocity lower than the circumferential velocity of the image carrier when the image carrier and the transfer unit are separate from each other, and output drive force to drive the transfer unit such that the transfer unit rotates at a circumferential velocity higher than the circumferential velocity of the image carrier when the image carrier and the transfer unit are in contact with each other.

The object and advantages of the invention will be realized and attained by means of the elements and combinations particularly pointed out in the claims.

It is to be understood that both the foregoing general description and the following detailed description are exemplary and explanatory and are not restrictive of the invention as claimed.

Other objects and further features of the present invention will be apparent from the following detailed description when read in conjunction with the accompanying drawings.

DESCRIPTION OF THE PREFERRED EMBODIMENTS

Figure 1:
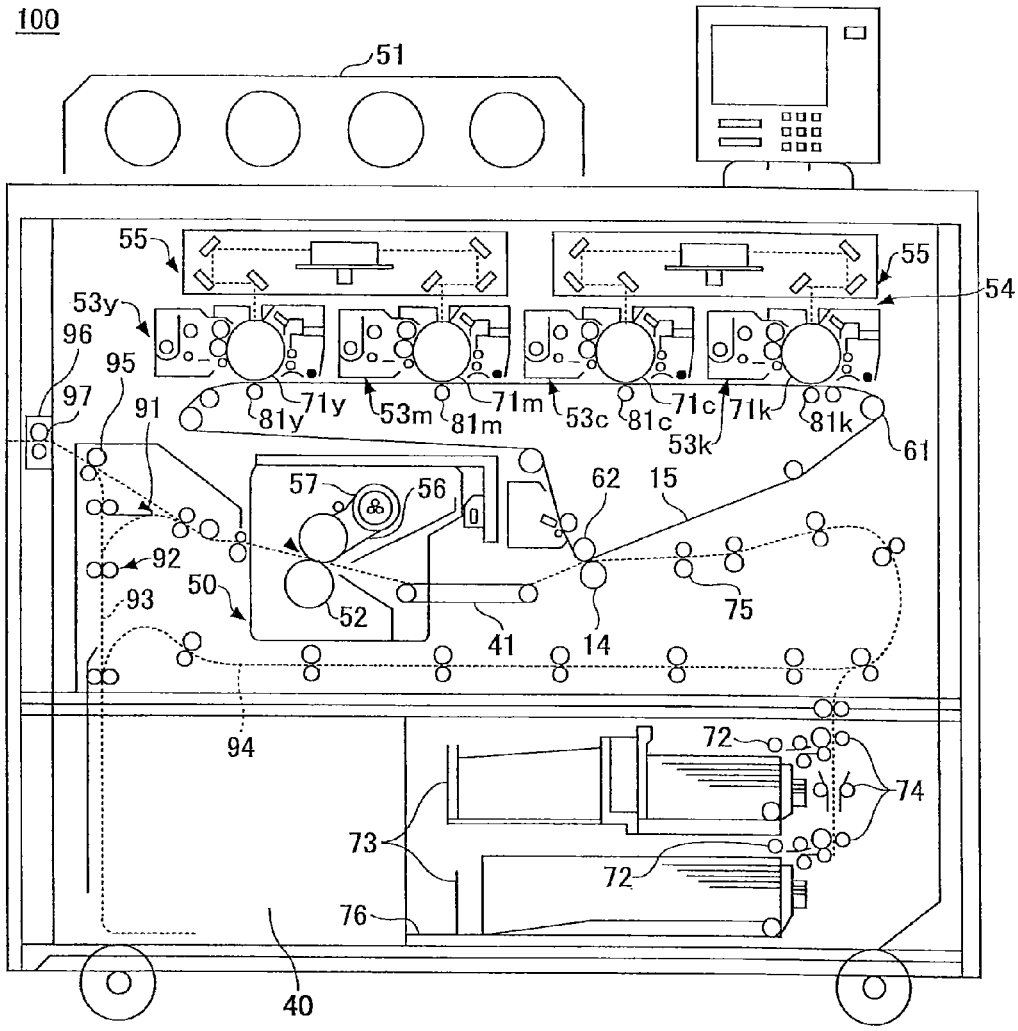
FIG. 1 is a diagram illustrating a schematic configuration example of an image forming apparatus according to an embodiment.

In the following, a description will be given of embodiments of the present invention with reference to the accompanying drawings. In the drawings, identical components are designated by the same reference numerals, and duplicated descriptions thereof may be omitted.

Configuration of Image Forming Apparatus

FIG. 1 is a diagram illustrating a schematic configuration example of an image forming apparatus 100 according to an embodiment.

The image forming apparatus 100 includes an image forming unit configured to include a tandem image forming device 54, an intermediate transfer belt 15, and a secondary transfer roller 14, such that the image forming unit may form an image on a sheet S serving as a recording medium such as a sheet of paper or an overhead projector (OHP) sheet.

The intermediate transfer belt 15 is an example of an image carrier, and is disposed approximately in the middle of the image forming apparatus 100. The intermediate transfer belt 15 is looped over plural rollers such that the intermediate transfer belt 15 is rotatable in a clockwise direction. The intermediate transfer belt 15 is configured to be rotationally driven by a rotationally driving roller 61.

The tandem image forming device 54 is configured to include plural developing devices disposed along the intermediate transfer belt 15. Each of the developing devices 53 (i.e., 53*m*, 53*c*, 53*k*, and 53*y*) in the tandem image forming device 54 is configured to include a photoconductor drum 71 (i.e., 71*m*, 71*c*, 71*k*, or 71*y*) configured to carry a toner image of a corresponding one of colors. An exposure device 55 is disposed above the tandem image forming device 54. The exposure device 55 is configured to expose the photoconductor drum 71 having a uniformly electrostatically-charged surface to form electrostatic latent images.

Further, a primary transfer roller 81 (i.e., 81*m*, 81*c*, 81*k*, or 81*y*) is disposed at a position facing a corresponding one of the photoconductor drums 71 via the intermediate transfer belt 15. This position serves as a primary transfer position at which the toner image is transferred from the photoconductor drum 71 to the intermediate transfer belt 15. The toner image formed in the photoconductor drum 71 is transferred onto the intermediate transfer belt 15 at a position between the primary transfer roller 81 and the intermediate transfer belt 15.

The toner image primarily transferred onto the intermediate transfer belt 15 is secondarily transferred onto a sheet S transported by being sandwiched between the intermediate transfer belt 15 and the secondary transfer roller 14. The secondary transfer roller 14 is an example of a transfer unit, and is rotationally disposed at a position opposite to the tandem image forming device 54 via the intermediate transfer belt 15. That is, the secondary transfer roller 14 is rotationally disposed at a position downstream in an intermediate transfer belt 15 transporting direction. Further, the secondary transfer roller 14 is disposed such that the secondary transfer roller 14 comes in contact with the intermediate transfer belt 15 or is separate from the intermediate transfer belt 15. Hence, the secondary transfer roller 14 is pressed by a roller 62 to generate transfer fields. Since the transfer fields are generated in a state where the secondary transfer roller 14 is in contact with the intermediate transfer belt 15, the image on the intermediate transfer belt 15 is secondarily transferred onto the sheet S.

A fixing device 50 is configured to include a halogen lamp 57 as a heat source, a fixing belt 56 serving as an endless belt, and a pressure roller 52 being pressed against the fixing belt 56. The fixing belt 50 is configured to change temperatures of the fixing belt 56 and the pressure roller 52, which are parameters of a fixing condition, a nip width between the fixing belt 56 and the pressure roller 52, and the velocity of the pressure roller 52, based on a type, thickness, and the like of the sheet S. The sheet S is, after the image is transferred onto the sheet S, transported by a transporting belt 41 from the secondary transfer roller 14 to the fixing device 50.

When the image forming apparatus 100 receives transmitted image data to receive image forming start signals, a not illustrated driving motor rotationally drives a roller 61, such that other rollers are rotationally driven to rotate with the intermediate transfer belt 15. Simultaneously, each of the developing devices 53 forms a corresponding one of single color images on a corresponding one of the photoconductor drums 71. The single color images formed in the developing devices 53 are sequentially transferred onto the rotationally driven intermediate transfer belt 15 to superpose the sequentially transferred single color images over one another, thereby forming a composite color image.

Further, the sheet S is dispensed from one of feed cassettes 73 by one of feed rollers 72 of a feed table 76 being selected and rotated, and the dispensed sheet S is then transported by a transport roller 74. Thereafter, the transported sheet S is stopped by reaching a resist roller 75. The resist roller 75 is configured to correct a transporting direction or orientation of the sheet S, so that the sheet S is transported by the resist roller 75 rotating simultaneously with an image forming timing at which the composite color image on the intermediate transfer belt 15 reaches the secondary transfer roller 14. The composite color image formed on the intermediate transfer belt 15 is transported to the secondary transfer roller 14, where the composite color image on the intermediate transfer belt 15 is transferred onto a surface (front surface or first surface) of the sheet S.

The sheet S onto which the composite color image has been transferred is transported by the transporting belt 41 to the fixing device 50, where the transferred composite color image is melted by the application of heat and pressure to the sheet S to fix the transferred composite color image on the sheet S. For duplex printing, the sheet S on the surface of which the transferred composite color image has been fixed is transported by a branching claw 91 and a flip roller 92 to a sheet inverting path 93 and a two surface transporting path 94, where the composite color image is formed on a rear surface (second surface) of the sheet S.

Further, for inverting the sheet S, the branching claw 91 guides the sheet S to the sheet inverting path 93 to invert the sheet S from its front surface (first surface) to its rear surface (second surface). For simplex printing or printing without sheet inversion, the branching claw 91 transports the sheet S to a discharge roller 95. The sheet inverting path 93 and the two surface transporting path 94 serve as inverting transport units, and are configured to invert, after the image has been formed on one of the front surface (first surface) and the rear surface (second surface), the sheet S from its front surface (first surface) to its rear surface (second surface), or to invert the sheet S from its front end to its rear end. The inverted sheet S is then directed and transported toward the secondary transfer device 14.

The sheet S on one surface or two surfaces of which the image is printed is transported by the discharge roller 95 to a decurling unit 96. In the decurling unit 96, the decurling amount is changed based on the sheet S by changing the amount of pressure applied to a decurling roller 97 to reduce the amount of curl of the sheet S. The sheet S having a reduced amount of burl is then discharged outside from the image forming apparatus 100.

Note that the image forming apparatus 100 according to the embodiment is configured to transfer a color toner image formed on the intermediate transfer belt 15 onto the sheet S. However, the image forming apparatus 100 according to the embodiment may be configured to transfer respective single color toner images formed on plural photoconductor drums 71 directly onto the sheet S by superposing the respective single color toner images onto one another.

Figure 2:
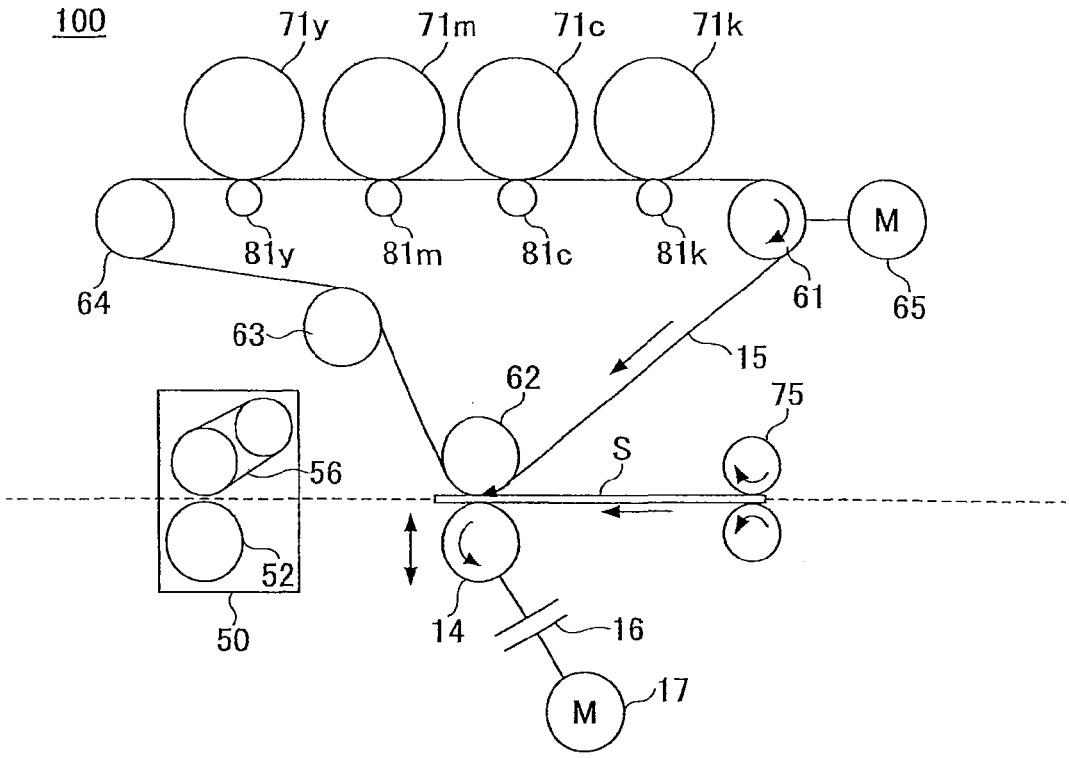
FIG. 2 is a diagram illustrating a schematic configuration example of a main part of the image forming apparatus according to the embodiment.

FIG. 2 is a diagram illustrating a schematic configuration example of a main part of the image forming apparatus 100 according to the embodiment.

As illustrated in FIG. 2, the image forming apparatus 100 according to the embodiment includes an intermediate transfer belt 15 serving as an image carrier, and a secondary transfer roller 14 serving as a transfer unit.

The intermediate transfer belt 15 is looped over plural rollers 61, 62, 64, and the like, and is configured to be rotationally driven by the rotationally driving roller 61. The roller 61 is connected to a motor 65. Hence, the motor 65 rotationally driving the roller 61 such that the intermediate transfer belt 15 rotationally travels at a predetermined circumferential velocity via the roller 61.

The secondary transfer roller 14 is configured to rotate by receiving drive force from the motor 17, and configured to come into contact with or be separate from the intermediate transfer belt 15 by a not-illustrated contact/separate mechanism. Specifically, the secondary transfer roller 14 is configured to be separate from the intermediate transfer belt 15 to prevent the intermediate transfer belt 15 from abrasion while the image forming apparatus 100 does not perform printing, whereas the secondary transfer roller 14 is configured to come into contact with the intermediate transfer belt 15 while the image forming apparatus 100 performs printing.

A torque limiter 16 is configured to be disposed on the drive mechanism configured to transmit drive force from the motor 17 to the secondary transfer roller 14. The torque limiter 16 is an example of a torque limit unit, and is configured to block the drive force output from the motor 17 to the secondary transfer roller 14 when the load applied is greater than or equal to the set limited torque.

Further, a cleaning unit configured to clean the surface of the secondary transfer roller 14 such as a blade or a brush, and a discharging unit configured to discharge waste toner collected by the cleaning unit from the surface of the secondary transfer roller 14 are disposed in the vicinity of the secondary transfer roller 14.

Figure 3A:
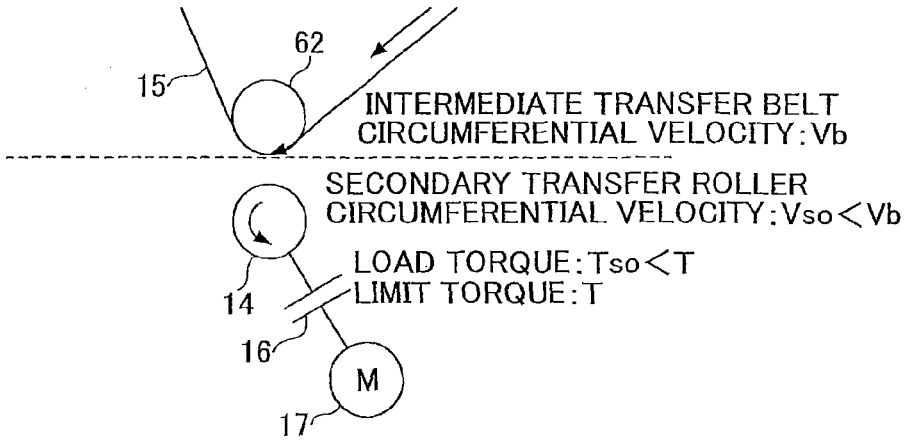
FIGS. 3A to 3B are diagrams illustrating operations of an intermediate transfer belt and a secondary transfer roller of the image forming apparatus according to the embodiment when the intermediate transfer belt and the secondary transfer roller come into contact with each other and are separate from each other.
Figure 3B:
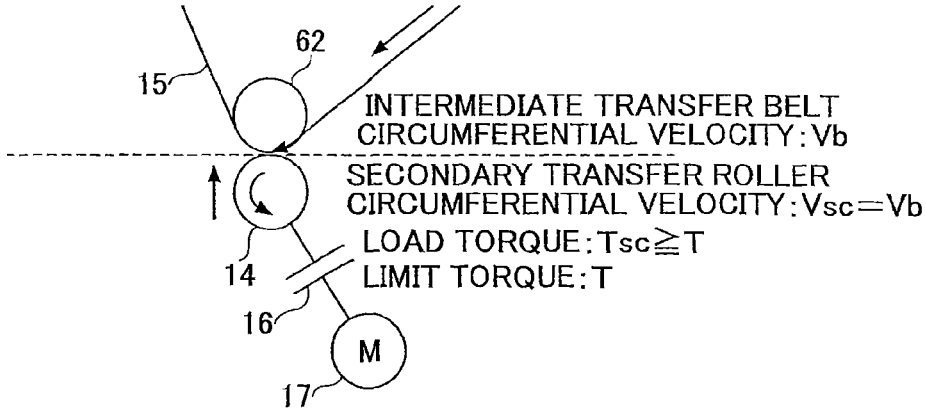

Contacting/Separating Operations between Intermediate Transfer Belt and Second Transfer Roller Next, a description is given of contacting/separating operations of the intermediate transfer belt 15 and the secondary transfer roller 14 when the intermediate transfer belt 15 and the secondary transfer roller 14 come into contact with each other and are separate from each other, with reference to FIGS. 3A and 3B. FIG. 3A illustrates a state where the intermediate transfer belt 15 and the secondary transfer roller 14 are separate from each other (in a separate state), and FIG. 3B illustrates a state where the intermediate transfer belt 15 and the secondary transfer roller 14 come into contact with each other (in a contact state).

Separated Status between Intermediate Transfer Belt and Secondary Transfer Roller As illustrated in FIG. 3A, the intermediate transfer belt 15 and the secondary transfer roller 14 are separate from each other when the image forming apparatus 100 does not perform printing. Hence, the intermediate transfer belt 15 and the secondary transfer roller 14 start rotating with the intermediate transfer belt 15 and the secondary transfer roller 14 being separated from each other when the image forming apparatus 100 starts printing.

The intermediate transfer belt 15 and the secondary transfer roller 14 are rotationally driven such that the following relationship is satisfied. In the following relationship, Vb represents the circumferential velocity of the intermediate transfer belt 15, and Vso represents the circumferential velocity of the secondary transfer roller 14 in a separate state where the intermediate transfer belt 15 and the secondary transfer roller 14 are separated from each other.

Secondary transfer roller circumferential velocity Vso<Intermediate transfer belt circumferential velocity Vb Note that a limit torque T of the torque limiter 16 is set such that the following relationship is satisfied. In the following relationship, Tso represents a load torque applied to the torque limiter 16 from the secondary transfer roller 14 rotating at the circumferential velocity Vso, and T represents the limit torque of the torque limiter 16 in the separate state where the intermediate transfer belt 15 and the secondary transfer roller 14 are separated from each other.

Load torque Tso in the separate state<Limit torque T of torque limiter

With the above-described settings, the torque Tso of the secondary transfer roller 14 is less than the limit torque T when drive force for rotating the secondary transfer roller 14 at a circumferential velocity Vso is output from the motor 17 in the separate state where the intermediate transfer belt 15 and the secondary transfer roller 14 are separated from each other. As a result, the secondary transfer roller 14 rotates at a circumferential velocity Vb by receiving the drive force from the motor 17.

The secondary transfer roller 14 is rotationally disposed even in the separate state where the intermediate transfer belt 15 and the secondary transfer roller 14 are separated from each other. Hence, the cleaning unit may be able to clean the surface of the secondary transfer roller 14, and the discharging unit may be able to discharge the waste toner when the intermediate transfer belt 15 and the secondary transfer roller 14 are separated from each other.

Contacting Operations between Intermediate Transfer Belt and Secondary Transfer Roller As illustrated in FIG. 3B, when the image forming apparatus 100 performs printing, the roller 62 facing the secondary transfer roller 14 is caused by a not-illustrated contact/separate mechanism to press the secondary transfer roller 14 such that the secondary transfer roller 14 is brought into contact with the intermediate transfer belt 15.

When the secondary transfer roller 14 is brought into contact with the intermediate transfer belt 15, the circumferential velocity Vso of the secondary transfer roller 14 is lower than the circumferential velocity Vb of the intermediate transfer belt 15 in a manner similar to a case where the secondary transfer roller 14 is separate from the intermediate transfer belt 15. Hence, the impact applied to the intermediate transfer belt 15 may be reduced by causing the secondary transfer roller 14 to come into contact with the intermediate transfer belt at the circumferential velocity Vso lower than the circumferential velocity Vb of the intermediate transfer belt 15.

After the secondary transfer roller 14 and the intermediate transfer belt 15 are in contact with each other, the motor 17 drives the secondary transfer roller 14 such that the secondary transfer roller 14 rotates at the circumferential velocity higher than the circumferential velocity Vb of the intermediate transfer belt 15. In this state, when Tsc represents load torque applied to the torque limiter, the limit torque T of the torque limiter 16 is set such that the limit torque T of the torque limiter 16 satisfies the following relationship.

Load torque Tsc in the contact state≥Limit torque T of torque limiter

Hence, the load torque Tsc of the torque limiter 16 is greater than or equal to the limit torque T when the motor 17 outputs the drive force to drive the secondary transfer roller 14 to rotate at the circumferential velocity higher than or equal to the circumferential velocity Vb of the intermediate transfer belt 15 in a state where the secondary transfer roller 14 is in contact with the intermediate transfer belt 15. This causes the torque limiter 16 to slip. When the torque limiter 16 slips, the drive force from the motor 17 to the secondary transfer roller 14 is blocked. As a result, the secondary transfer roller 14 is rotated at the circumferential velocity Vsc equal to the circumferential velocity Vb of the intermediate transfer belt 15 by following the traveling (rotations) of the intermediate transfer belt 15 or the travelling of the sheet S.

When the secondary transfer roller 14 comes into contact with the intermediate transfer belt 15, the circumferential velocity Vso of the secondary transfer roller 14 is lower than the circumferential velocity Vb of the intermediate transfer belt 15. As a result, the impact applied to the intermediate transfer belt 15 when the secondary transfer roller 14 comes into contact with the intermediate transfer belt 15 may be reduced. Further, after the secondary transfer roller 14 is in contact with the intermediate transfer belt 15, the motor 17 is accelerated to activate the torque limiter 16, and the secondary transfer roller 14 is rotated at constant velocity by following the traveling (rotations) of the intermediate transfer belt 15. As a result, the image quality will not be degraded due to deviation in positions of the images transferred onto the sheet S.

Separating Operations between Intermediate Transfer Belt and Secondary Transfer Roller When the secondary transfer roller 14 that is in contact with the intermediate transfer belt 15 is separate from the intermediate transfer belt 15, the motor 17 drives the secondary transfer roller 14 such that the secondary transfer roller 14 rotates at the circumferential velocity Vso lower than the circumferential velocity Vb of the intermediate transfer belt 15. The load torque applied to the torque limiter 16 will be lower than the limit torque T by allowing the motor 17 to drive at a reduced velocity. As a result, the drive force from the motor 17 is transmitted to the secondary transfer roller 14 such that the secondary transfer roller 14 rotates at the circumferential velocity Vso.

Hence, when the secondary transfer roller 14 is separate from the intermediate transfer belt 15, the contact/separate mechanism causes the secondary transfer roller 14 to be separate from the intermediate transfer belt 15 in a state where the secondary transfer roller 14 rotates at the circumferential velocity Vso lower than the circumferential velocity Vb of the intermediate transfer belt 15. That is, the impact applied to the intermediate transfer belt 15 may be reduced by causing the secondary transfer roller 14 to be separate from the intermediate transfer belt 15 at the circumferential velocity Vso lower than the circumferential velocity Vb of the intermediate transfer belt 15.

Next, illustration is given of specific examples of setting values in the above-described configurations when the contacting/separating operations are performed between the intermediate transfer belt 15 and the secondary transfer roller 14 (i.e., operations in which the secondary transfer roller 14 is brought into contact with and is separate from the intermediate transfer belt 15).

Separate State

Intermediate transfer belt 15 circumferential velocity Vb: 440 mm/s

Secondary transfer roller 14 circumferential velocity Vso: 437 mm/s

Torque limiter 16 load torque: 1.3 kg·cm

In separating operations, to allow environmental fluctuations such as temperature and humidity to some extent, the circumferential velocity Vso of the secondary transfer roller 14 may, for example, be set at −0.6% with respect to the circumferential velocity Vb of the intermediate transfer belt 15. Hence, the circumferential velocity Vso of the secondary transfer roller 14 will not exceed the circumferential velocity Vb of the intermediate transfer belt 15.

Note that the secondary transfer roller 14 receives drive force output from the motor 17 such that the secondary transfer roller 14 rotates at the circumferential velocity Vso lower than the circumferential velocity Vb of the intermediate transfer belt 15 by setting a value of the limit torque of the torque limiter 16 at 1.3 kg·cm or greater.

Contacting Operations

Intermediate transfer belt 15 circumferential velocity Vb: 440 mm/s

Secondary transfer roller 14 circumferential velocity Vsc: 440 mm/s

Torque limiter 16 load torque: 1.3 kg·cm

After the secondary transfer roller 14 and the intermediate transfer belt 15 are in contact with each other, the motor 17 may, for example, drive the secondary transfer roller 14 such that the secondary transfer roller 14 rotates at the circumferential velocity of 443 mm/s.

The load torque applied to the torque limiter 16 increases from 0.9 to 2.0 kg·cm by accelerating the driving of the motor 17 after the secondary transfer roller 14 and the intermediate transfer belt 15 are in contact with each other.

Note that setting a value of the limit torque of the torque limiter 16 at less than 2.0 kg·cm in advance will cause the torque limiter 16 to slip when the driving of the motor 17 accelerates after the secondary roller 14 and the intermediate transfer belt 15 are in contact with each other. After the driving of the motor 17 accelerates so that the torque limiter 16 starts slipping, the secondary transfer roller 14 is rotated at a constant velocity by following the traveling (rotations) of the intermediate transfer belt 15.

Separating Operations

Intermediate transfer belt 15 circumferential velocity Vb: 440 mm/s

Secondary transfer roller 14 circumferential velocity Vso: 437 mm/s

Torque limiter 16 load torque: from 2.0 to 0.9 kg·cm

Further, in the separating operations of the secondary transfer roller 14 being separate from the intermediate transfer belt 15, the motor 17 may, for example, drive the secondary transfer roller 14 such that the secondary transfer roller 14 rotates at the lower circumferential velocity of 437 mm/s. When the motor is driven at a lower velocity, the load torque of the torque limiter 16 is lowered (from 2.0 to 0.9 kg·cm) to be less than or equal to the limit torque. As a result, the secondary transfer roller 14 rotates at the circumferential velocity of 437 mm/s lower than the circumferential velocity of the intermediate transfer belt 15 again. In the above state, the contact/separate mechanism causes the secondary transfer roller 14 to be separate from the intermediate transfer belt 15.

As illustrated above, in the image forming apparatus 100 according to the embodiment, when the secondary transfer roller 14 is separate from the intermediate transfer belt 15, the motor 17 drives the secondary transfer roller 14 such that the secondary transfer roller 14 rotates at the circumferential velocity lower than the circumferential velocity of the intermediate transfer belt 15. By contrast, when the secondary transfer roller 14 is in contact with the intermediate transfer belt 15, the motor 17 drives secondary transfer roller 14 such that the secondary transfer roller 14 comes into contact with the intermediate transfer belt 14 at the circumferential velocity lower than the circumferential velocity of the intermediate transfer belt 15. As a result, the impact applied to the intermediate transfer belt 15 may be reduced, which may, for example, prevent misalignment of the toner images formed on the intermediate transfer belt 15.

In addition, after the secondary transfer roller 14 and the intermediate transfer belt 15 are in contact with each other, the motor 17 drives the secondary transfer roller 14 such that the secondary transfer roller 14 rotates at the circumferential velocity higher than the circumferential velocity of the intermediate transfer belt 15. The load torque applied to the torque limiter 16 will exceed the limit torque T by allowing the motor 17 to drive at an accelerated velocity. As a result, the torque limiter 16 slips to allow the drive force of the motor 17 to be blocked from the secondary transfer roller 14 such that the secondary transfer roller 14 is rotated at the constant velocity by following the traveling (rotations) of the intermediate transfer belt 15. Accordingly, the circumferential velocity of the intermediate transfer belt 15 and the sheet S transporting velocity are maintained at a constant velocity, which may prevent degradation of the image quality due to deviation in positions of the transferred images.

In addition, in the separating operations of the secondary transfer roller 14 being separate from the intermediate transfer belt 15, the secondary transfer roller 14 is caused to be separate from the intermediate transfer belt 15 after the motor 17 has driven the secondary transfer roller 14 such that the secondary transfer roller 14 rotates at the circumferential velocity lower than the circumferential velocity of the intermediate transfer belt 15. By causing the secondary transfer roller 14 to be separate from the intermediate transfer belt 14 at the circumferential velocity lower than the circumferential velocity of the intermediate transfer belt 15, the impact applied to the intermediate transfer belt 15 may be reduced, which may, for example, prevent damage to the intermediate transfer belt 15.

Note that the above-described embodiment illustrates an example of causing the secondary transfer roller 14 to come in contact with, and be separate from the intermediate transfer belt 15 at the circumferential velocity of the secondary transfer roller 14 of approximately at 0.6% lower than the circumferential velocity of the intermediate transfer belt 15, so that the circumferential velocity of the secondary transfer roller 14 will not exceed the circumferential velocity of the intermediate transfer belt 15.

Further, the above embodiment illustrates an example in which the secondary transfer roller 14 serves as the transfer unit. However, an endless transfer belt looped over plural rollers may be used in place of the secondary transfer roller 14.

Figure 4:
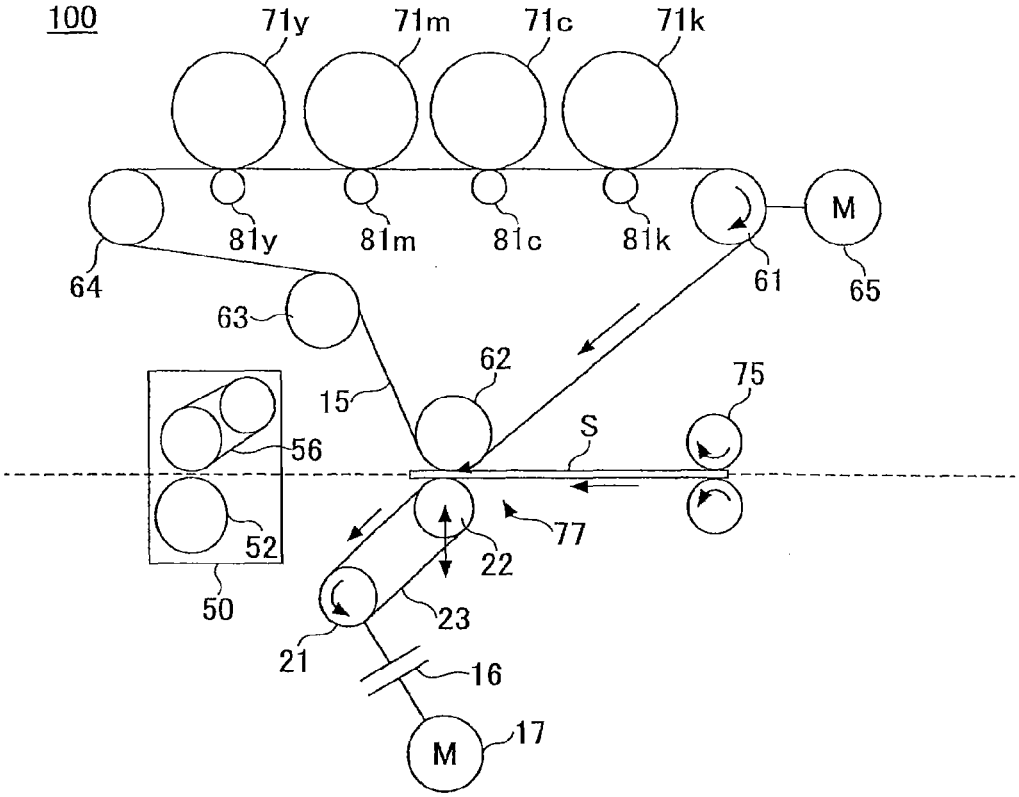
FIG. 4 is a diagram illustrating another configuration example of an image forming apparatus according to the embodiment.

FIG. 4 is a diagram illustrating a schematic configuration example of an image forming apparatus 100 according to an embodiment in which such an endless transfer belt is used as the transfer unit.

As illustrated in FIG. 4, a secondary transfer belt 23 is looped over plural rollers 21 and 22, and is configured to be rotationally driven by following rotations of a rotationally driving roller 21 driven by the motor 17.

The roller 21 is connected to the motor 17 via a drive mechanism, and is configured to be rotationally driven by receiving drive force from the motor 17. The torque limiter 16 is disposed on the drive mechanism disposed between the roller 22 and the motor 17. Note that the motor 17 may alternatively be connected to the roller 22 via the torque limiter 16.

The roller 22 is configured to be brought into contact with or be separate from the intermediate transfer belt 15 along with the secondary transfer belt 23 via a not-illustrated contact/separate mechanism.

In such a configuration, when the contacting/separating operations of the intermediate transfer belt 15 and the secondary transfer belt 23 are performed, the motor 17 and the torque limiter 16 may operate such that a circumferential velocity of the secondary transfer belt 23 is lower than the circumferential velocity of the intermediate transfer belt 15 in a manner similar to the above-described embodiment. Further, after the intermediate transfer belt 15 and the secondary transfer belt 23 are in contact with each other, the torque greater than or equal to the limit torque is applied to the torque limiter 16 by the acceleration of the motor 17. This causes the torque limiter 16 to slip such that the secondary transfer belt 23 is rotated at a constant velocity by following traveling (rotations) of the intermediate transfer belt 15.

Hence, with such a configuration, the impact applied to the intermediate transfer belt 15 may be lowered, and the circumferential velocity of the intermediate transfer belt 15 will not fluctuate, which may prevent the degradation of the image quality in the contacting/separating operations of the intermediate transfer belt 15 and the secondary transfer belt 23.

Further, the image forming apparatus 100 may be a monochrome image forming apparatus or a color image forming apparatus configured to directly transfer toner images from a photoconductor drum onto the sheet S. In such a case, toner images formed on the photoconductor drum are transferred onto the transported sheet S between the photoconductor drum serving as an image carrier and its counterpart transfer roller serving as the transfer unit facing the photoconductor drum. In such a configuration, impact applied to the photoconductor drum when the transfer roller is brought into contact with or is separate from the photoconductor drum may be reduced by disposing a motor and a torque limiter similar to those used in the above-described embodiment on the transfer roller. Further, degradation of the image quality may be prevented by causing the photoconductor drum and the transfer roller to rotate at a constant velocity after the transfer roller is in contact with the photoconductor drum.

According to the above-described embodiments, there is provided an image forming apparatus capable of reducing impact applied when the image carrier and the transfer unit are brought into contact with each other and are separate from each other, and capable of preventing image degradation due to fluctuation occurring in a circumferential velocity of the image carrier or a transporting velocity of the recording medium.

The invention is described on the basis of the embodiments described above; however, the invention is not limited to those embodiments. Various alterations and modifications may be made within the scope of the invention.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiment of the present invention has been described in detail, it should be understood that various changes, substitutions, and alterations could be made hereto without departing from the spirit and scope of the invention.

The present application is based on and claims the benefit of priority of Japanese Priority Application No. 2012-256051 filed on Nov. 22, 2012, the entire contents of which are hereby incorporated by reference.

What is claimed is:

1. An image forming apparatus, comprising:

an image carrier configured to carry an image while being rotationally driven;

a transfer unit rotationally disposed with respect to the image carrier and capable of being brought into contact with or separate from the image carrier, the transfer unit being configured to transfer the image onto a recording medium transported by being sandwiched between the transfer unit and the image carrier;

a torque limit unit disposed on a drive mechanism configured to transmit drive force to rotate the transfer unit, and configured to transmit drive force to the transfer unit at a torque less than a torque for transmitting drive force, the drive force transmitted to the transfer unit driving the transfer unit to rotate at a circumferential velocity higher than a circumferential velocity of the image carrier in a state where the image carrier and the transfer unit are in contact with each other; and a drive unit configured to output drive force to drive the transfer unit such that the transfer unit rotates at a circumferential velocity lower than the circumferential velocity of the image carrier when the image carrier and the transfer unit are separate from each other, and output drive force to drive the transfer unit such that the transfer unit rotates at a circumferential velocity higher than the circumferential velocity of the image carrier when the image carrier and the transfer unit are in contact with each other.

2. The image forming apparatus as claimed in claim 1, wherein in contacting operations of causing the transfer unit to be in contact with the image carrier, the drive unit is configured to output drive force to the drive mechanism to drive the transfer unit such that the transfer unit rotates at a circumferential velocity higher than the circumferential velocity of the image carrier after the transfer unit is in contact with the image carrier.

3. The image forming apparatus as claimed in claim 1, wherein in separating operations of causing the transfer unit to be separate from the image carrier, the drive unit is configured to output drive force to the drive mechanism to drive the transfer unit such that the transfer unit rotates at a circumferential velocity lower than the circumferential velocity of the image carrier before the transfer unit is separate from the image carrier.

4. The image forming apparatus as claimed in claim 1, wherein the image carrier is an endless belt configured to be looped over a plurality of rollers having at least one roller, and be rotationally driven by following rotations of the at least one roller.

5. The image forming apparatus as claimed in claim 1, wherein the transfer unit is an endless belt configured to be looped over a plurality of rollers having at least one roller, and be rotationally driven by following rotations of the at least one roller.

6. The image forming apparatus as claimed in claim 1, wherein the torque limit unit is a torque limiter.

* * * * *